US005286216A

United States Patent [19]

Volz

[11] Patent Number: 5,286,216

[45] Date of Patent: Feb. 15, 1994

[54] RETROFIT SYSTEM FOR ENERGY EFFICIENT LIGHTING

[76] Inventor: George A. Volz, 2373 NW. Johnson, Portland, Oreg. 97210

[21] Appl. No.: 929,184

[22] Filed: Aug. 10, 1992

[51] Int. Cl.[5] ..... H01R 33/02

[52] U.S. Cl. ..... 439/236; 439/646; 362/217

[58] Field of Search ..... 362/216, 217, 260; 313/318; 439/226, 232, 233, 236, 306, 360, 642, 645, 646

[56] References Cited

U.S. PATENT DOCUMENTS

| | | | |
|---|---|---|---|
| 2,626,300 | 1/1953 | Hoorn | 439/306 |
| 4,093,333 | 6/1978 | Tjornhom, Sr. | 439/306 |
| 4,936,789 | 6/1990 | Ugalde | 439/236 |

*Primary Examiner*—Larry I. Schwartz
*Assistant Examiner*—Khiem Nguyen
*Attorney, Agent, or Firm*—Robert L. Harrington

[57] ABSTRACT

A retrofit system for dedicated an Edison-type socket to receive only energy efficient lighting components. The retrofit system includes a power unit, an energy efficient lamp and an adapter. The adapter is arranged to be readily installed in the socket, but once installed it is not removable. The adapter is arranged for the removable mounting of the power unit and the power unit is arranged for the removable mounting of the energy efficient lamp. The retrofit system permits the exchange or replacement of either or both of the power unit and energy efficient lamp as required but does not permit conversion back to the inefficient incandescent lighting.

8 Claims, 2 Drawing Sheets

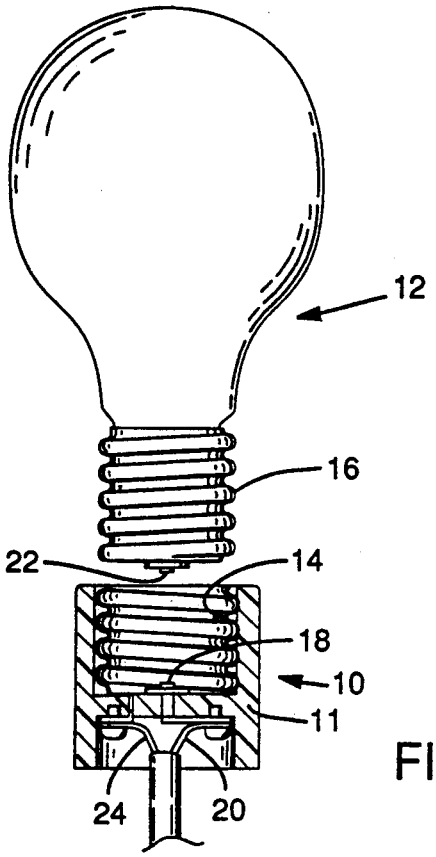
FIG. 1
Prior Art
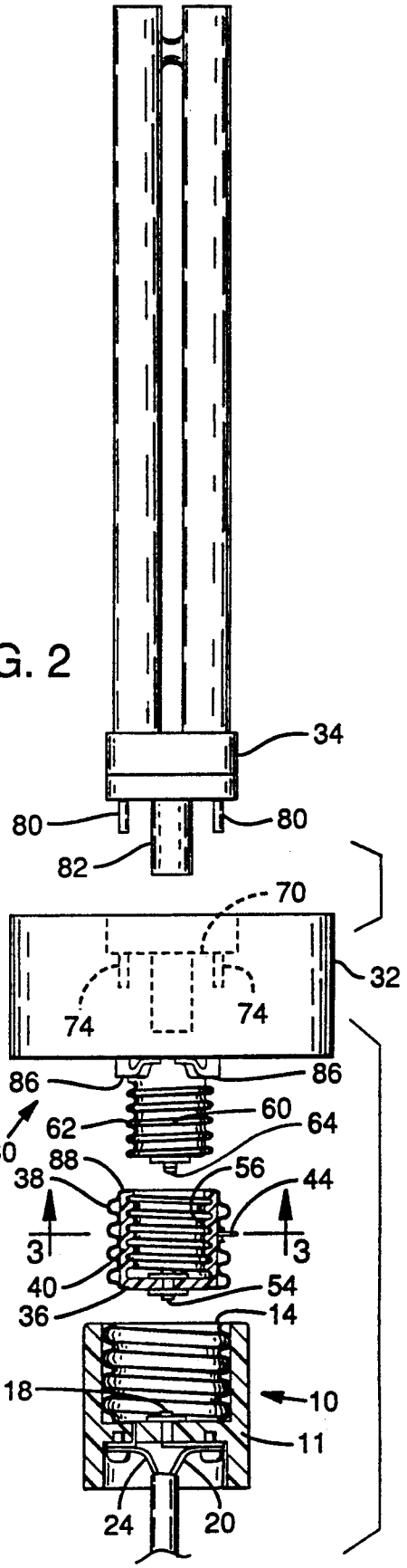
FIG. 2
FIG. 3
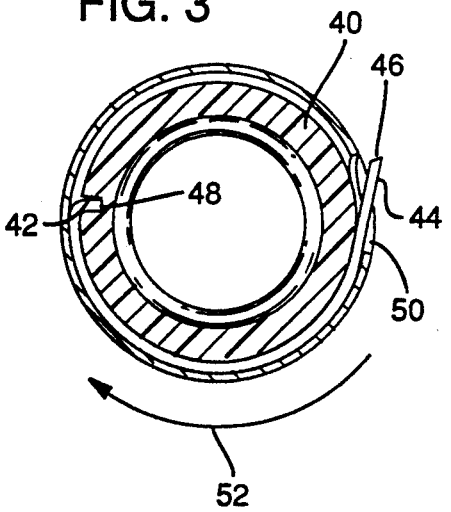

RETROFIT SYSTEM FOR ENERGY EFFICIENT LIGHTING

BACKGROUND INFORMATION

1. Field of the Invention

This invention relates to the conversion of high energy consuming incandescent lighting to energy efficient lighting and particularly to a conversion system that is non-reversible.

2. Background of the Invention

Incandescent lamps, commonly referred to as light bulbs, have widespread usage in providing illumination. The lamps are produced with a standardized threaded base that will fit into a standard Edison-type threaded socket. The lamps are installed by merely screwing the base of the lamp into the socket. Replacing a lamp or interchanging the lamp with another of a different wattage rating is thus a simple task. The lamp is simply screwed out of the socket and the replacement lamp is screwed into the socket. The lamps come in a variety of wattage ratings and are interchangeable in the standard socket. The socket is not limited with respect to the wattage rating of the lamp to be utilized so a 15 watt lamp for example may be exchanged for a 100 watt lamp. The selection of the lamp size is generally left up to the consumer, although many light fixtures using the standard sockets have a recommended maximum wattage rating.

The incandescent lamp, although it is still widely used and accepted as an illuminating unit, has several drawbacks. The lamps are not energy efficient, they generate unwanted heat during use and generally have a relatively short life.

Energy efficient lighting systems, such as fluorescent, is widely used to provide lighting in office buildings, factories and the like. The fixtures for the fluorescent lighting are most often arranged to accept long fluorescent tubes such as tubes of four foot or eight foot lengths although other lengths and configurations are available. The fluorescent lighting fixtures are arranged to receive fluorescent tubes only and are not configured to accept the interchange of other lighting units such as incandescent lamps.

The recognition of the benefits of low energy consumption, longer life and less heat generated by the fluorescent lighting has led to the development of compact energy efficient lamp units that are directly interchangeable with the incandescent lamps. To change over, the incandescent lamp is simply removed from the conventional lamp receiving socket and the energy efficient lamp unit is installed in the socket. Changeover is that easy and simple. The problem is it is also just as easy to change back to the old inefficient lighting provided by the incandescent lamps.

The initial cost of the energy efficient lighting unit is more than that of the incandescent lamp it is to replace. The higher initial cost coupled with the ability of converting back to usage of the incandescent lamp has deterred the conversion to energy efficient lighting. There therefore has been a reluctance on the part of manufacturers, power companies and others to promote the retrofit of incandescent lighting systems to the energy efficient lighting systems that are currently available on the market. Some power companies will not offer incentives, such as rebates, for the purchase of energy efficient lighting since the user may readily convert back to the old high energy consuming incandescent lamp. Currently there is no assurance that a user will continue usage of the energy efficient lighting system. Should a failure occur with an energy efficient light system, such as failure of a ballast or fluorescent tube, the energy efficient light system may be merely removed from the socket and replaced with a low cost incandescent lamp. Thus, when the energy efficient lamp or the lamp and ballast fail, a user may readily convert back to the high energy consuming incandescent lamp. This is to be avoided. The user, although benefitting in the short term by purchasing the low cost replacement incandescent lamp will lose in the long term by the increased power usage and the necessity to purchase multiple incandescent lamps since they have a shorter life.

There currently is not a way to retrofit and dedicate the conventional socket to the energy efficient lamps to insure continued usage of the energy efficient lamps. A system is required that will dedicate an incandescent lamp receiving socket to receive only energy efficient lighting systems and prevent the switch over to the old incandescent lighting system.

BRIEF SUMMARY OF THE INVENTION

The present invention is a retrofit system for converting and dedicating a high energy consuming incandescent lighting system to an energy efficient lighting system. A preferred embodiment of the present invention includes an adapter mountable in a standard Edison type incandescent lamp receiving socket. The adapter is readily screwed into the lamp receiving socket but has a projecting member or a protrusion that prevents removal of the adapter. The adapter has internal threads of a form that will only accept the thread form of a power unit of an energy efficient light unit such as provided on a ballast. The ballast is arranged to accept fluorescent lamps. The adapter thus dedicates the conventional Edison type socket to an energy efficient lighting system. The adapter once it is installed in the conventional lamp receiving socket may not be removed and a user is likely to replace the energy efficient component as required rather than converting back to the old inefficient incandescent lighting system. The present invention retrofits and dedicates a lighting system from a high energy consuming lighting system to an energy efficient lighting system. The energy efficient lighting system also discourages theft since the adapter is not removable and the removable energy efficient lighting component will not fit in the conventional socket without the adapter.

PRIOR ART

A type of non-removable adapter of interest is the adapter utilized in the old style fuse boxes. Adapters were developed that limited a fuse receiving socket to a usage range. The fuse box utilized screw-in one-time meltable fuses. The original fuse box had standard fuse receiving sockets and a user could readily change the fuse by simply screwing out the old one and screwing in a replacement. This was determined to be a hazard. A user, not familiar with or disregarding the purpose of the recommended fuse size, may just insert a larger fuse in the event a fuse of the recommended size continues to "blow". An adapter was developed that was insertable into the socket but had a protrusion that prevented its removal. The adapter has a special internal thread form that would only accept the thread form of a range of fuses. Thus an adapter was configured to accept fuses that were within a certain range. An adapter would for example accept fuses that were of a rated capacity within a range, such as 7 to 15 amps. The adapter did not convert the protection system of the fuse box but merely limited the size rating of the fuse that could be inserted into the adapter. The adapter(s) used in the fuse boxes did not convert or retrofit the fuse box from one type of circuit protection to another. It did not for example retrofit the one time meltable fuse system to a resetting device such as a circuit breaker. The main purpose of the adapters used in the fuse box was to limit the range of fuse size that could be installed to provide the recommended protection for a circuit.

There are also socket adapters available that permit the usage of incandescent lamps with a smaller base in the conventional Edison socket. The adapter is in effect a small socket within a standard base. The base of the adapter fits in the standard Edison socket. The small socket in the adapter will accept incandescent lamps having a small base. The adapter of this type does not convert or retrofit the lighting system from one type to another but allows the usage of a smaller base lamp in the standard Edison type socket. When it is desired to revert back to standard base lamp, the socket adapter is simply removed from the standard socket.

Refer now to the drawings and the detailed description for a full understanding of the invention.

BRIEF DESCRIPTION OF THE DRAWINGS

FIG. 1 is a view of a lighting system of the prior art showing a conventional socket and an incandescent lamp;

FIG. 2 is an exploded view of an energy efficient lighting system of the present invention for converting and limiting the socket of FIG. 1 to energy efficient lighting;

FIG. 3 is view of the adapter of the energy efficient lighting system of FIG. 2 as viewed on view lines 3—3;

DESCRIPTION OF THE PREFERRED EMBODIMENT

Figure 4:
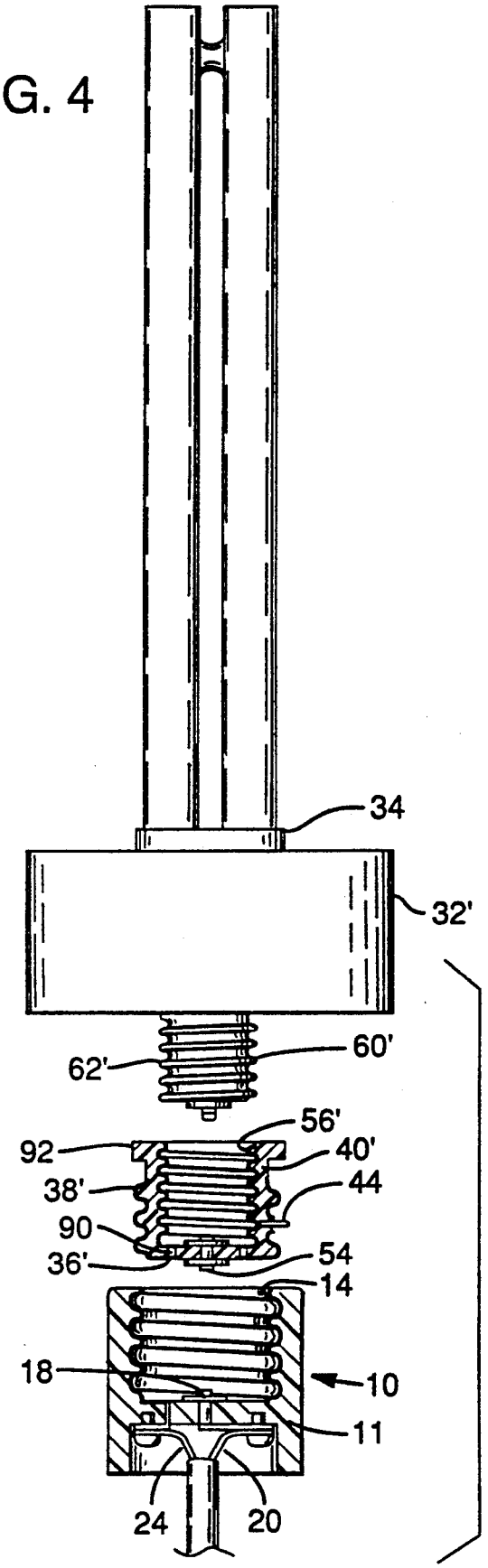
FIG. 4 is a view of another embodiment of an energy efficient lighting system of the present invention.

Refer now to FIG. 1 of the drawings. Illustrated is a known Edison-type lamp receiving socket 10 and an incandescent lamp 12. The socket 10 is arranged to receive the incandescent lamp 12, commonly referred to as a light bulb. The socket 10 is generally in the form of an open ended cylinder and in the illustration the body 11 of the socket is formed of porcelain. It is recognized that many other types of sockets are available and are constructed out of a variety of different materials. The sockets, regardless of the type, have standardized internal female threads 14 which will receive the threaded base 16 of the bulb 12. The internal threads 14 of the socket 10 and the threaded portion of base 16 of the bulb 12 are of electrically conductive material, such as metal. The socket 10 has a center tap 18 which is connectable to the input side of a power supply by an input wire 20. The internal threads 14 of the socket 10 are connectable to the output side of the power supply and is shown connected to wire 24. It is known that the bulb 12 has a center post 22 that is electrically connected to one end of a filament within the bulb 12. The opposite end of the filament is electrically connected to the threaded portion of base 16. The bulb 12 is installed in the socket 10 by screwing the bulb into the socket until the center post 22 makes contact with the center tap 18. The filament of the bulb will thus be electrically connected to the power supply. A switch is generally provided in a known manner to control power to the socket 10 and thus to the bulb 12. The switch may be included in the socket itself or may be located remote from the socket in a separate receptacle.

The bulb 12 may be readily installed or removed from the socket 10. The bulb is installed by simply screwing it in and it is removed by simply screwing it out. A conventional incandescent lamp 12 has been illustrated with a socket 10 in FIG. 1 to show the ease of installation and removal of the bulb 12. The socket 10 is not, however, limited or restricted to receive only incandescent bulbs 12. Other lighting units, such as energy efficient fluorescent lamps, having a thread form conforming to the internal threads 14 of the socket 10 may be readily installed and removed from the socket 10 as well. The conventional socket 10 is therefore not limited or restricted to receive only a particular type of lamp.

Refer now to FIG. 2 of the drawings which illustrates in exploded view an energy efficient retrofit lighting system 30 and a conventional socket 10. The retrofit lighting system 30 is arranged for retrofitting and dedicating a conventional Edison-type socket 10 to receive only an energy efficient lighting system. In this embodiment the energy efficient lighting component of the system 30 is of the fluorescent type and includes a compact power unit (ballast) 32, and a fluorescent lamp 34 mountable in the power unit 32. A retrofitting adapter 36 is provided to mount the power unit 32 in a medium size conventional incandescent lamp receiving socket 10.

The adapter 36 is utilized to limit the socket 10 to receive only energy efficient lighting systems. The adapter 36 is readily installed in the socket 10, but once installed it is not removable. The adapter 36 has threads 38 on its external periphery of a form and length that will mate with the internal threads 14 of the lamp receiving socket 10. A lock mechanism is provided on the adapter 36 for preventing removal of the adapter from the socket 10 once it is installed. In this embodiment, a protrusion in the form of a stiff resilient wire 44 is extended through a relief (opening) 50 in the crest of one of the threads 38 of the adapter 36. The wire 44 extends in a near tangent manner to the crest of the thread form 38 and has the same helical angle as the threads 38. The relief 50 is of sufficient length to receive the extended length of the wire 44. The end of the wire 44 extending out of the relief 50 is cut at an angle to form a chisel end 46. The opposite end 48 of the wire 44 fits in a notch 42 in the body 40 of the adapter 36 and thus the wire 44 is anchored to the adapter 36. An alternative method of fixedly securing the wire 4 to the adapter 36 is to solder the wire to the interior of the material forming the threads 38.

The adapter 36 is mountable in the socket 10 by screwing it into the socket in a conventional manner by rotating the adapter relative to the socket in the direction indicated by arrow 52 in FIG. 3. As the adapter 36 is rotated into the socket 10, the wire 44 extending out of the relief 50 will be urged against the root of the internal threads 14 of the socket 10. The extended portion of the wire 44 will be in sliding engagement with the root of the threads 14, the resiliency of the stiff wire urging the wire 44 against the root of the threads 14. The end 46 of the wire 44 is in effect trailing and the wire acts as an inclined plane permitting the wire to cooperatively slide along the root of the threads 14. The adapter 36 is rotated until it is securely installed in the socket 10 with the center tip 54 of the adapter in contact with the center tab 18 of the socket 10. Once the adapter 36 is installed in the socket 10, the protruding end of the wire 44 acts as a lock mechanism to prevent removal of the adapter 36 from the socket 10. The chisel end 46 of the wire 44 being urged against the root of the threads 14 will positively engage, that is will dig into the root of the threads 14 to prevent rotation of the adapter 36 counter to arrow 52 relative to the socket 10. The end 46 of the wire 44 is sufficiently sharp to ensure positive engagement with the root of the threads 14 to prevent rotation of the adapter relative to the socket and will lock the adapter 36 in the socket to thus prevent removal of the adapter 36 from the socket 10

The adapter 36 is configured in a manner so that only energy efficient lighting components may be installed or connected to the adapter. A socket 10 having an adapter 36 installed will thus be dedicated to only receive energy efficient lighting components. The adapter may, by way of example, have an internal shape that is of some geometric configuration such as triangular, square, trapezoidal or other and the energy efficient lighting component will have a conforming shape that is mateable with the configured form of the adapter. The configured form of the adapter 36 and the energy efficient lighting component are selected so as to be special to energy efficient lighting. In this embodiment the adapter 36 has internal threads 56 of a form that will accept the threads 62 of the base 60 of the power unit 32. The thread form of the threads 56 and the thread form of the threads 62 are selected to have a form that is non-standard or unique in the industry and thus are dedicated to energy efficient lighting. The tip 64 on the base 60 will contact the center post 54 of the adapter 36 when the base 60 of the power unit 32 is screwed into the adapter 36. The power unit 32 may be readily installed or removed from the adapter 36 by simply screwing it in or screwing it out.

The power unit 32 has a configured opening 70 for the removable mounting of a fluorescent lamp 34. Pin receiving sockets 74 are provided in the base of the opening 70 for receiving the connecting pins 80 of the fluorescent lamp 34. The bottom or base of the fluorescent lamp 34, generally indicated by the numeral 82 is configured to fit in the opening 70 with the connecting pins 80 fitting in the receiving sockets 74. In this embodiment, the lamp 34 is retained in the installed position by frictional engagement of the bottom 82 with the opening 70. The lamp 34 thus may be readily removed or installed in the power unit 32.

Power is supplied to the lamp 34 via the wire 20 connected to the center tap 18 of the socket 10. Upon installation of the adapter 36 and the lighting component of the system 30 in the adapter, the center tap 18 will be electrically connected to the power unit 32 via the center post 54 of the adapter 36 and the center post 64 of the power unit 32. Power is supplied to the lamp 34 from the power unit 32 via one of the pins 80 received in a pin receiving socket 74. Power return from the lamp 34 to the power unit 32 is via the other pin 80 received in the other socket 74. Contacts 86 on the power unit 32 adjacent the base 60 are engaged with top 88 of the conductive material forming the threads 38 that is rolled over the top of the body of the adapter 36. The external threads 38 of the adapter are engaged with the internal threads 14 of the socket 10 which in turn is connected to the return wire 24.

To retrofit the socket 10 to receive only energy efficient lighting units, the adapter 36 is screwed into the socket 10. The power unit 32 is then installed in the adapter 36 and the lamp 34 is installed in the power unit 32. Once the adapter 36 is installed in the socket 10, the only lighting unit that may be installed are energy efficient light units that have the unique thread form to fit in the adapter 36. Should replacement of either or both the power unit 32 and lamp 34 be required, they may be readily removed and replaced. The adapter 36, on the other hand, once it is installed in the socket 10 may not be removed. The present invention thus retrofits and dedicates a lamp receiving socket to receive only energy efficient lighting.

FIG. 4 illustrates another embodiment of the energy efficient lighting system of the present invention. As shown, an adapter 36' is installable in the socket 10 in the same manner as the adapter 36 of FIG. 2. The adapter 36' has internal threads 56' electrically connected to the external threads 38' by a connecting pin 90. The internal threads 56' and the external threads 38' are formed from an electrically conductive material such as metal. The base 60' of the power unit 32' has external threads 62' mateable with the threads 56' of the adapter 36'. The threads 62' provide the electrical path from the power unit 32' to the internal threads 56'. As shown, the external threads 38' are spaced at a distance from the upper flange 92 of the adapter 36'. The body 40' of the adapter 36' including the flange portion 92 are non-conductive and thus provides a measure of safety for installing the adapter 36' in the socket 10. The adapter 36' has the same locking mechanism in the form of a protruding wire 44 as provided on the adapter 36. The lamp 34 is shown installed in the power unit 32'.

It will be apparent to those skilled in the art that modifications and variations may be made without departing from the true spirit and scope of the invention. The invention is therefore not to be limited to the embodiments described and illustrated, but is to be determined from the appended claims.

What is claimed is:

1. An energy efficient retrofit lighting system for retrofitting a standard incandescent lamp receiving socket to receive only an energy efficient light component, said system comprising:

an incandescent lamp receiving socket, a standardized thread provided on the interior of said socket;

an adaptor, external threads provided on said adapter exterior mateable with the interior threads of said socket, said adapter threadably installable in said socket, a connector provided on said adapter separate from said external threads;

an energy efficient lighting component including a power unit and an energy efficient lamp, a connector provided on said component mateable with the connector of said adapter for removably mounting said component to said adapter, said connector of said adapter being non-mateable with the standard threads of an incandescent lamp; and a lock mechanism, said lock mechanism cooperatively permitting installation of said adapter in said socket and locking said adapter in said socket to prevent removal of said adapter from said socket.

2. An energy efficient retrofit lighting system for retrofitting a standard incandescent lamp receiving socket to receive only an energy efficient light component, said system comprising:

an incandescent lamp receiving socket, a standardized thread provided on the interior of said socket;

a cylindrical adapter, internal threads provided on the interior of said adapter, said internal threads of a non-standard form, external threads provided on its external mateable with the interior threads of said socket, said adapter threadably installable in said socket;

an energy efficient lighting component including a power unit and an energy efficient lamp, a cylindrical base extends from said component, external threads provided on said base mateable with the internal thread form of the adapter, said energy efficient lighting component removably mountable in said adapter; and, a lock mechanism, said lock mechanism cooperatively permitting installation of said adapter in said socket and locking said adapter in said socket to prevent removal of said adapter from said socket.

3. An energy efficient retrofit lighting system as defined in claim 2 wherein:

a cylindrical base extends from said power unit, external threads provided on the power unit base mateable with the internal threads of said adapter, said power unit removably mountable in said adapter, said power unit having an opening for receiving said lamp, a base extending from said lamp configured to fit in said opening and said energy efficient lamp removably mountable in said power unit.

4. An energy efficient retrofit lighting system as defined in claim 3, wherein:

said power unit is a ballast and said energy efficient lamp is a fluorescent lamp.

5. An energy efficient retrofit lighting system as defined in claim 2, wherein:

said lock mechanism includes a member protruding from said adapter, said member cooperatively engaging said socket during rotational installation of said adapter in said socket and positively engaging said socket upon counter rotation of said adapter thereby prohibiting rotational removal of said adapter from socket.

6. An energy efficient retrofit lighting system as defined in claim 5, wherein:

said external threads of said adapter have an opening, said member is a wire, an end of the wire extending through the opening; and, the extended end of the wire is in cooperatively sliding contact with said socket during rotational installation of said adapter in said socket and positively engaging said socket upon counter rotation of said adapter to thereby lock said adapter in said socket.

7. An energy efficient retrofit lighting system as defined in claim 1, wherein said adapter comprises a body portion, an electrical conductor provided on said body portion for conducting electricity between said socket and said lighting component, a flange portion protruded above said body portion, said flange portion provided of non-conductive material, said flange providing a finger hold for a user to safely install the adapter in the socket.

8. An energy efficient retrofit lighting system as defined inc claim 1 wherein:

said power unit and said energy efficient lamp are separable, said connector for connecting the energy efficient lighting component to the adapter provided on said power unit and removable from the connector of the adapter for removably connecting the power unit to the adapter, and said energy efficient lamp removably connected to said power unit for selective replacement of the power unit and lighting component as desired.

* * * * *